US005773746A

United States Patent [19]

Vaden

[11] Patent Number: 5,773,746

[45] Date of Patent: Jun. 30, 1998

[54] COUPLER FOR ATTACHING A SUPPRESSOR TO A FIREARM FLASH HIDER

[76] Inventor: Philip D. Vaden, 9712 Thorngrove Pike, Strawberry Plains, Tenn. 37871

[21] Appl. No.: 787,247

[22] Filed: Jan. 24, 1997

[51] Int. Cl.[6] ..... F41A 21/00

[52] U.S. Cl. ..... 89/14.4; 89/14.2; 181/223

[58] Field of Search ..... 89/14.4, 14.2, 89/14.05; 181/223

[56] References Cited

U.S. PATENT DOCUMENTS

| | | | |
|---|---|---|---|
| D. 349,147 | 7/1994 | Gwinn, Jr. | D22/108 |
| 1,054,434 | 2/1913 | Maxim | 89/14.4 |
| 1,354,416 | 9/1920 | Oliver | 89/14.4 |
| 1,525,846 | 2/1925 | Wurtzebach | 89/14.4 |
| 4,510,843 | 4/1985 | Rabatin | 89/14.4 |
| 4,726,280 | 2/1988 | Frye | 89/16 |
| 4,893,426 | 1/1990 | Bixler | 89/14.05 |
| 4,939,977 | 7/1990 | Stroup | 89/14.4 |
| 5,136,923 | 8/1992 | Walsh, Jr. | 89/14.2 |
| 5,415,073 | 5/1995 | Ciluffo | 89/14.2 |
| 5,433,133 | 7/1995 | La France | 89/14.2 |
| 5,509,345 | 4/1996 | Cyktich | 89/14.05 |
| 5,559,302 | 9/1996 | Latka | 89/14.05 |

*Primary Examiner*—Michael J. Carone
*Assistant Examiner*—Theresa M. Wesson
*Attorney, Agent, or Firm*—Pitts & Brittian, P.C.

[57] ABSTRACT

A coupler for attaching a suppressor to a firearm flash hider. The coupler includes a main body, an inner collar, and an outer collar. The main body defines a through bore configured to closely receive the flash hider at one end and for the passage of the bullet at the other. The main body defines a first threaded portion proximate the central portion thereof, the threads being right-handed threads. The main body defines a sound suppressor attachment device at the second end thereof. The inner collar defines a through bore oriented coaxially thereto. A first end of the through bore is configured to receive the first end of the main body. Proximate the second end of the inner collar, the through bore defines a second inner diameter dimensioned to receive the firearm flash hider. The inner collar carries a plurality of locking fingers, each pivotally mounted on the inner collar via a pivot pin. When the inner collar is received over the flash hider, the fingers are pivoted toward the barrel in order to prevent axial movement of the flash hider with respect to the coupler. The inner collar also defines a threaded portion, the threads having a left-handed orientation. The outer collar defines an inner diameter configured to closely receive the main body first end and the inner collar. At a central portion of the interior of the outer collar, a first threaded portion is configured to cooperate with the first threaded portion defined by the main body. At the first end of the outer collar interior, a second threaded portion is configured to cooperate with the inner collar threaded portion.

12 Claims, 6 Drawing Sheets

COUPLER FOR ATTACHING A SUPPRESSOR TO A FIREARM FLASH HIDER

Technical Field

This invention relates to the field of firearms. More specifically, this invention relates to a coupler for attaching a noise suppressor, or silencer, to the flash hider of a weapon such as an M-16 without causing damage to the weapon.

Background Art

In the field of weaponry, it is well known that silencers are used to reduce the noise associated with the firing of the weapon. Noise suppression is desired for various reasons. First, by reducing the noise associated with the firing of the weapon, it is harder to detect the location of the marksman, and quite possibly it is difficult to hear that a weapon has been fired at all. Especially in the case of larger caliber weapons such as an M-16, another benefit of a noise suppressor is to reduce the damage to the ears of the marksman. To this extent, it is well known that such weapons create a high volume of noise upon firing.

It is well known that a typical silencer is a device secured to the end of a barrel of a weapon. In order to mount the silencer, either the silencer itself is provided with means for mounting the silencer directly onto the weapon, or a coupler is provided. In the event that a coupler is provided, the coupler is mounted on the weapon and the silencer is in turn mounted on the coupler. However, several characteristics of these couplers make their use impractical or inefficient for use. Specifically, conventional couplers typical require a form of mounting which injures the weapon at the point of mounting. Further, the couplers can be time-consuming in the mounting thereof.

Several devices have been produced to mount a silencer onto the end of a weapon. Typical of the art are those devices disclosed in the following U.S. Pat. Nos.:

| U.S. Pat. No. | Inventor(s) | Issue Date |
|---|---|---|
| 4,510,843 | R. U. Rabatin | Apr. 16, 1985 |
| 4,726,280 | G. Frye | Feb. 23, 1988 |
| 4,939,977 | L. J. Stroup | July 10, 1990 |
| 5,136,923 | D. J. Walsh, Jr. | Aug. 11, 1992 |
| 5,509,345 | J. M. Cyktich | Apr. 23, 1996 |
| Des. 349,147 | M. W. Gwinn, Jr. | July 26, 1994 |

Of these devices, that disclosed by Gwinn ('147) is a muzzle attachment for a firearm barrel. Although no securement device has been disclosed by Gwinn, it appears that the '147 device is received over the end of the barrel. It is not clear how the attachment is secured in place.

Frye ('280) and Walsh ('923) disclose devices which define threaded portions for cooperating with a threaded portion of a gun barrel. However, firearms do not typically define threaded portions on the barrels thereof Accordingly, in order to utilize a device such as the '280 and '923 devices, one must first modify the barrel to define such threaded portion.

Collet-type devices are disclosed by Rabatin ('843), Stroup ('977) and Cyktich ('345). These devices each define an extended portion which is received over the end of the barrel. The extended portion defines a number of radially-spaced slits, thus defining a corresponding number of fingers. A collar is then received over the fingers and engages a threaded portion. As the collar is tightened onto the fingers, the device is tightened onto the gun barrel. Of these three devices, only the '843 device disclosed by Rabatin provides a means for preventing the sound suppressor from moving along the length of the barrel as the collet loosens. However, Rabatin requires the replacement of the flash suppressor of the weapon. In either of these devices, after repeated firings, a collet-type device will tend to loosen, thereby creating a potential hazard.

None of the prior art devices cited discloses a device for coupling a sound suppressor to the flash suppressor, or flash hider, of a firearm. Moreover, none of the prior art devices discussed discloses a device which may be secured to a non-threaded barrel end in such a manner that the gun barrel will not be damaged.

Therefore, it is an object of this invention to provide a means for mounting a sound suppressor to the flash hider of a firearm.

It is also an object of the present invention to provide such a mounting device whereby mounting of the device on the firearm and use of the firearm while the device is mounted thereon does not cause harm to the barrel of the firearm.

Further, it is an object of the present invention to provide a device which may be quickly mounted to and dismounted from the flash hider of a firearm.

Still another object of the present invention is to provide such a device which does not compromise the safety of the firearm.

DISCLOSURE OF THE INVENTION

Other objects and advantages will be accomplished by the present invention which serves to mount a sound suppressor to the flash hider of a firearm such that mounting of the coupler on the firearm and use of the firearm while the coupler is mounted thereon does not cause harm to the barrel of the firearm. Furthermore, the coupler is designed to be quickly mounted to and dismounted from the flash hider of a firearm, and to be used such that the safety of the firearm is not compromised. The coupler is comprised generally of a main body, an inner collar, and an outer collar. The main body defines a first end and a second end, with a through bore defined coaxially thereto. The through bore is configured to closely receive the flash hider at one end and for the passage of the bullet at the other. A shoulder is defined within the through bore, which serves to limit the axial movement of the coupler with respect to the flash hider. The main body defines a first threaded portion proximate the central portion thereof, the threads being right-handed threads as defined by standard convention. The main body defines a sound suppressor attachment device between the central ring and the second end thereof The sound suppressor attachment device comprises second and third threaded portions provided to cooperate with threaded portions defined by a conventional sound suppressor.

The inner collar defines a through bore oriented coaxially thereto. A first end of the through bore is configured to receive the first end of the main body. Proximate the second end of the inner collar, the through bore defines a second inner diameter dimensioned to receive the firearm flash hider. The inner collar carries a plurality of locking fingers, each pivotally mounted on the inner collar via a pivot pin also received within a bracket defined by the inner collar on either side of the finger. Each finger defines an extended portion defining an engagement surface for engaging the proximal end of the firearm flash hider. The length of the extended portion is substantially equal to the thickness of the flash hider. When the inner collar is received over the flash hider, the fingers are pivoted toward the barrel in order to prevent axial movement of the flash hider with respect to the coupler. The inner collar also defines a threaded portion, the threads having a left-handed orientation. The threaded portion defines an outer diameter equal to the first threaded portion defined by the main body.

The outer collar defines a substantially cylindrical member having a through bore with an inner diameter configured to closely receive the main body first end and the inner collar. At a central portion of the interior of the outer collar, a first threaded portion is configured to cooperate with the first threaded portion defined by the main body. At the first end of the outer collar interior, a second threaded portion is configured to cooperate with the inner collar threaded portion. Thus, the first threaded portion defines a right-handed orientation while the second threaded portion defines a left-handed orientation.

In order to mount the coupler to a firearm, the inner collar is first placed over the flash hider, second end first. Then the first end of the outer collar is placed over the flash hider. Next, the main body first end is placed over the flash hider until the shoulder engages the distal end of the flash hider. The outer collar is then moved into engagement with the main body and is rotated to begin engagement between the main body first threaded portion and the outer collar first threaded portion. The inner collar is then moved into engagement with the outer collar first end and is rotated to begin engagement between the inner collar threaded portion and the outer collar second threaded portion. Finally, the outer collar is rotated in order to move the main body and the inner collar toward each other until the respective ends of the flash hider are engaged by the main body shoulder and the finger engagement surfaces. When such a position has been reached, the coupler is securely mounted to the flash hider and the sound suppressor may be mounted thereto.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A coupler for attaching a suppressor to a firearm flash hider incorporating various features of the present invention is illustrated generally at 10 in the figures. The coupler for attaching a suppressor to a firearm flash hider, or coupler 10, is designed for mounting a sound suppressor 108 to the flash hider 102 of a firearm such that mounting of the coupler 10 on the firearm and use of the firearm while the coupler 10 is mounted thereon does not cause harm to the barrel 100 of the firearm. Furthermore, the coupler 10 of the present invention is designed to be quickly mounted to and dismounted from the flash hider 102 of a firearm, and to be used such that the safety of the firearm is not compromised.

Figure 1:
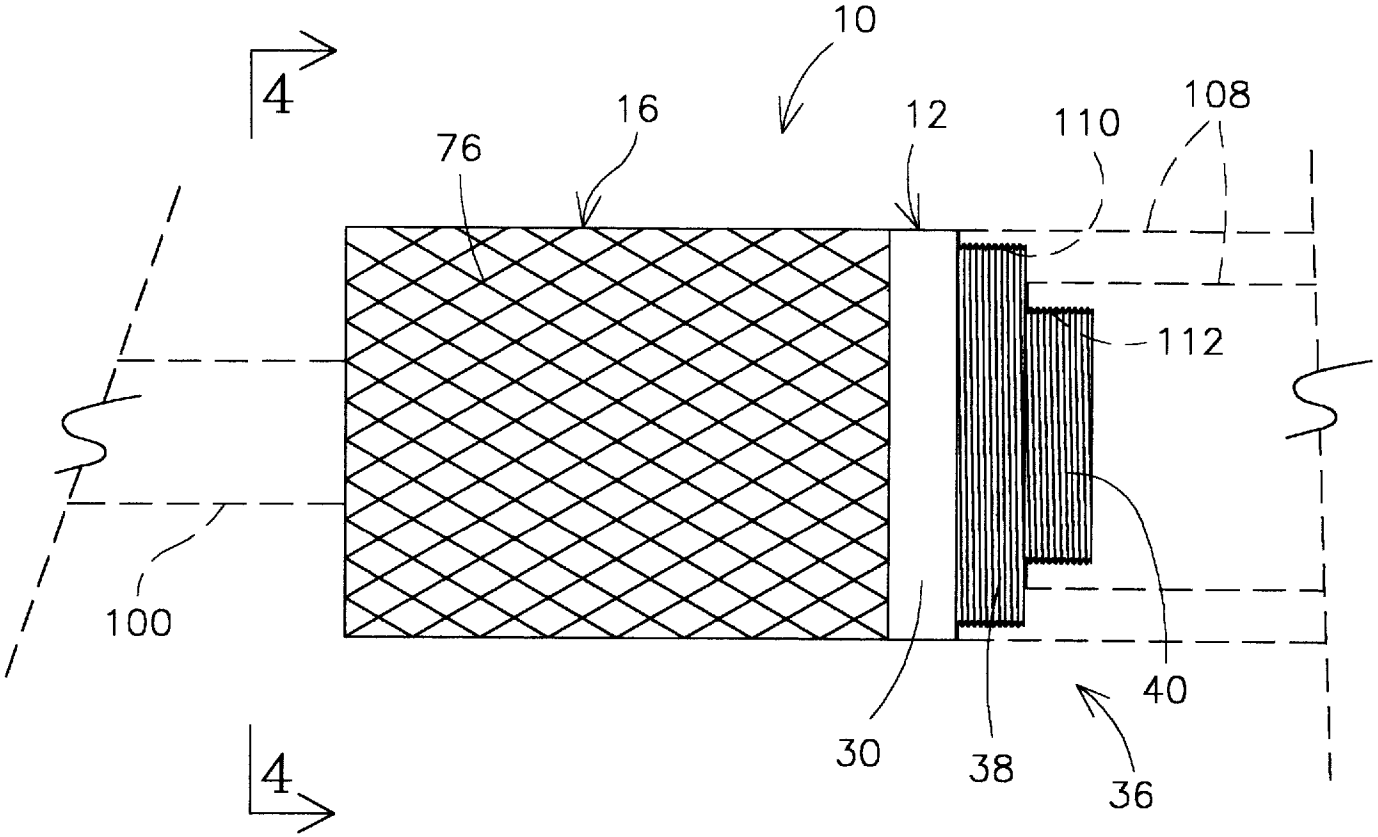
FIG. 1 is an elevation view of the coupler for attaching a suppressor to a firearm flash hider constructed in accordance with several features of the present invention.
Figure 2:
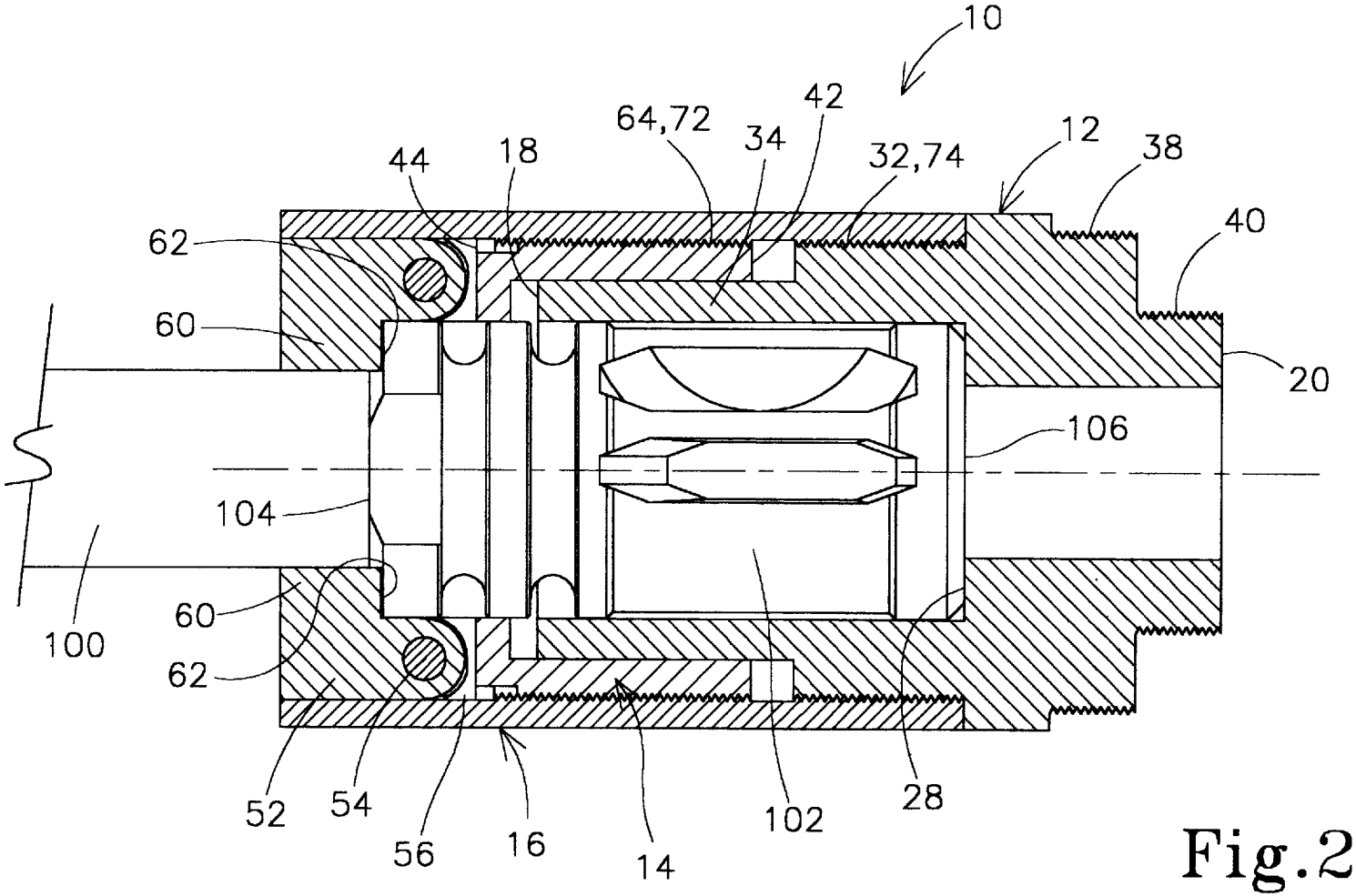
FIG. 2 illustrates an elevation view, in section, of the device of the present invention taken at 2—2 of FIG. 4.
Figure 3:
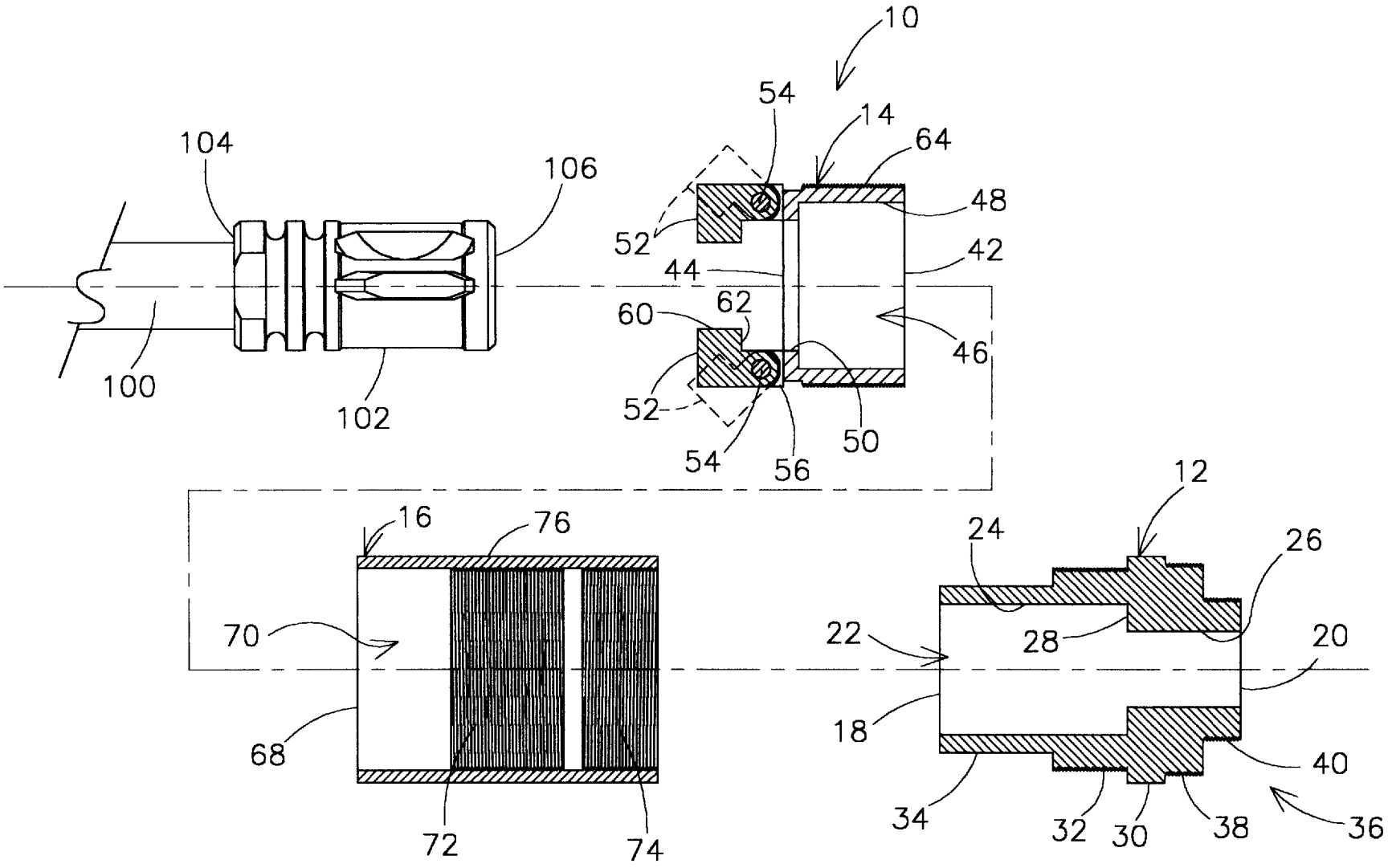
FIG. 3 is an exploded view of the elevation view illustrated in FIG. 4.

The coupler 10 of the present invention is comprised generally of a main body 12, an inner collar 14, and an outer collar 16. FIG. 1 illustrates the coupler 10 as it is mounted on the flash hider 102 of a conventional firearm such as an M-16. FIG. 2 more clearly illustrates the relationship between the main body 12, the inner collar 14, and the outer collar 16. FIG. 3 more clearly illustrates the individual features of each of these components.

As can be seen most clearly in FIG. 3, the main body 12 defines a first end 18 and a second end 20. A through bore 22 is defined coaxially to the main body 12, the through bore 22 being configured proximate the first end 18 to closely receive the flash hider 102 and proximate the second end 20 for the passage of a bullet (not shown). More specifically, the through bore 22 defines a first inner diameter 24 proximate the first end 18. The through bore 22 defines a second inner diameter 26 proximate the second end 20, the second inner diameter 26 being approximately equal to the bore of the gun barrel 100. A shoulder 28 is defined within the through bore 22, which serves to limit the axial movement of the coupler 10 with respect to the flash hider 102.

A central ring 30 is defined by the outer surface of the main body 12 proximate the shoulder 28, the central ring 30 defining a first outer diameter. Toward the first end 18 of the main body 12 and proximate the central ring 30 is defined a first threaded portion 32. The first threaded portion 32 defines a second outer diameter smaller than the first outer diameter. In the preferred embodiment, the threads of the first threaded portion 32 are right-handed threads as defined by standard convention. Between the main body first end 18 and the first threaded portion 32, the main body 12 defines a cylindrical configuration 34 having a third outer diameter smaller than the second outer diameter. The main body 12 defines a sound suppressor attachment device 36 between the central ring 30 and the second end 20 thereof. The sound suppressor attachment device 36 in the illustrated embodiment comprises second and third threaded portions 38,40. The second threaded portion 38 defines a fourth outer diameter smaller than the first outer diameter while the third threaded portion 40 defines a fifth outer diameter smaller than the fourth outer diameter. The second and third threaded portions 38,40 are provided to cooperate with threaded portions 110,112 defined by a conventional sound suppressor 108.

The inner collar 14 defines a through bore 46 oriented coaxially thereto. Proximate a first end 42 of the inner collar 14, the through bore 46 defines a first inner diameter 48 dimensioned to closely receive the first end 18 of the main body 12, or slightly larger than the main body third outer diameter. Proximate the second end 44 of the inner collar 14, the through bore 46 defines a second inner diameter 50 substantially equal to the first inner diameter 24 defined by the main body 12.

Figure 4:
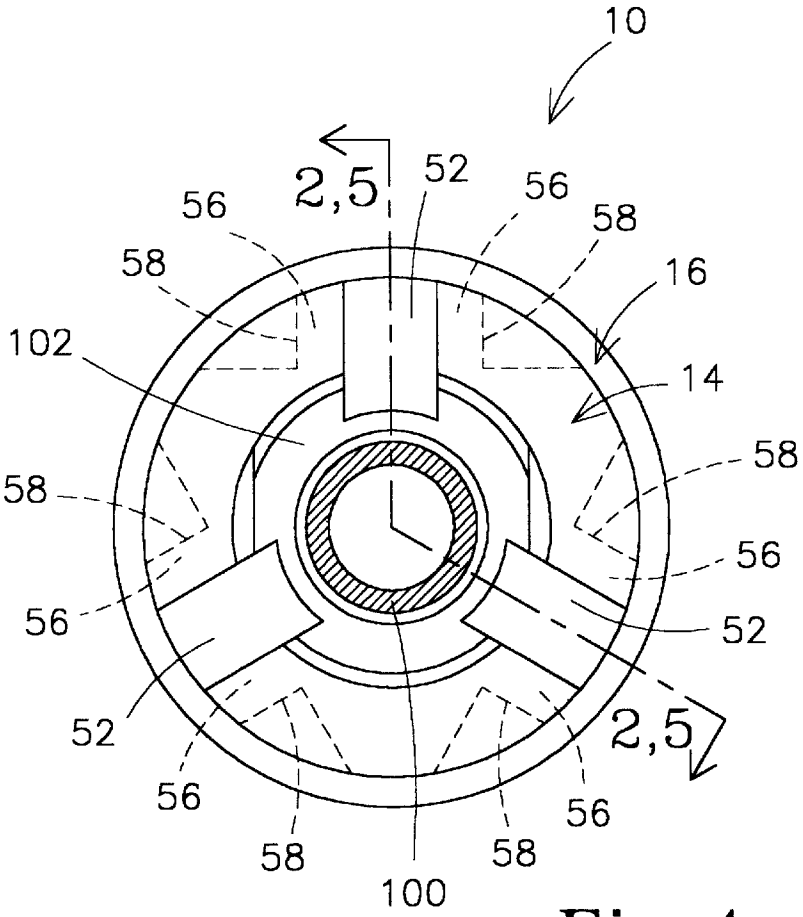
FIG. 4 is an end view, in section, of the device of the present invention, taken at 4—4 of FIG. 1.

As can be more clearly seen in the end elevation view of FIG. 4, the inner collar 14 carries a plurality of locking fingers 52. Each finger 52 is pivotally mounted on the inner collar 14 via a pivot pin 54 also received within a bracket 56 defined by the inner collar 14 on either side of the finger 52.

In order to facilitate mounting of each finger 52, a recess 58 is defined on the outside of each bracket 56. In the illustrated embodiment, three fingers 52 are provided, with radial spacing of one hundred twenty degrees (120°). It will be understood that more or fewer than three fingers 52 may potentially be incorporated. However, three such fingers 52 are preferred.

Each finger 52 defines an extended portion 60 defining an engagement surface 62 for engaging the proximal end 104 of the firearm flash hider 102. The length of the extended portion 60 is substantially equal to the thickness of the flash hider 102, or the difference in the outer radii of the barrel 100 and the flash hider 102. When the inner collar 14 is received over the flash hider 102, the fingers 52 are pivoted toward the barrel 100 in order to prevent axial movement of the flash hider 102 with respect to the coupler 10.

Referring again to FIG. 3, the inner collar 14 defines a threaded portion 64, the threads having a left-handed orientation. The threaded portion 64 defines an outer diameter equal to the second outer diameter (first threaded portion 32) defined by the main body 12.

The outer collar 16 defines a substantially cylindrical member having a through bore 70 with an inner diameter configured to closely receive the main body first end 18 and the inner collar 14. The outer diameter of the outer collar 16 is substantially equal to the first outer diameter (central ring 30) defined by the main body 12. At a central portion of the interior of the outer collar 16, a first threaded portion 74 is configured to cooperate with the first threaded portion 32 defined by the main body 12. At the first end 68 of the outer collar 16 interior, a second threaded portion 72 is configured to cooperate with the inner collar threaded portion 64. Thus, the first threaded portion 74 defines a right-handed orientation while the second threaded portion 72 defines a left-handed orientation. It will be seen, then, that when the coupler 10 is assembled on a firearm flash hider 102, as the outer collar 16 is turned one direction, the main body 12 and inner collar 14 will be moved away from one another, while rotation of the outer collar 16 in an opposite direction will move the main body 12 and inner collar 14 toward one another. To facilitate this rotation, the outer surface of the outer collar 16 is preferably knurled, thus providing a gripping surface 76.

In order to mount the coupler 10 to a firearm, the coupler 10 is first assembled. The outer collar 16 is placed in engagement with the main body 12 and is rotated to begin engagement between the main body first threaded portion 32 and the outer collar first threaded portion 74. The inner collar 14 is then moved into engagement with the outer collar first end 68 and is rotated to begin engagement between the inner collar threaded portion 64 and the outer collar second threaded portion 72. The fingers 52 are then pivoted back to the position indicated in FIG. 3 with broken lines and the coupler 10 is placed over the flash hider 102 until the main body shoulder 28 engages the distal end 106 of the flash hider 102. Finally, the outer collar 16 is rotated in order to move the main body 12 and the inner collar 14 toward each other until the respective ends 106,104 of the flash hider 102 are engaged by the main body shoulder 28 and the finger engagement surfaces 62. The outer collar 16 serves to push the fingers 52 into a closed position. The user may alternatively push the fingers 52 into the closed position if desired. When the respective ends 106,104 of the flash hider 102 are engaged by the main body shoulder 28 and the finger engagement surfaces 62, the coupler 10 is securely mounted to the flash hider 102 and the sound suppressor 108 may be mounted thereto. It will be seen that the mounting of the coupler 10 on the firearm, and the dismounting thereof, may be accomplished in a relatively short period of time, as compared to prior art devices. Further, because there are no requirements for altering the barrel 100 or the flash hider 102, and because the coupler 10 does not otherwise damage the barrel 100 or flash hider 102, it will be seen that the coupler 10 may be mounted and dismounted without damage to the firearm. Also, because of the particular construction as described, it will be seen that the coupler 10 will not damage the firearm when the firearm is fired.

Figure 6:
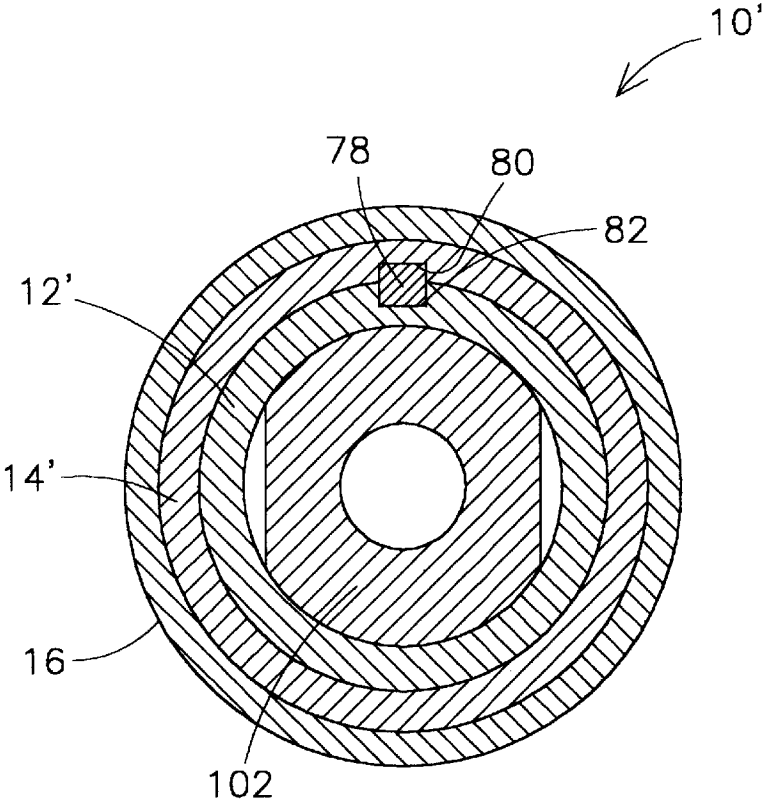
FIG. 6 is an end elevation view, in section, of the alternate embodiment of the device of the present invention taken at 6—6 of FIG. 5.
Figure 5:
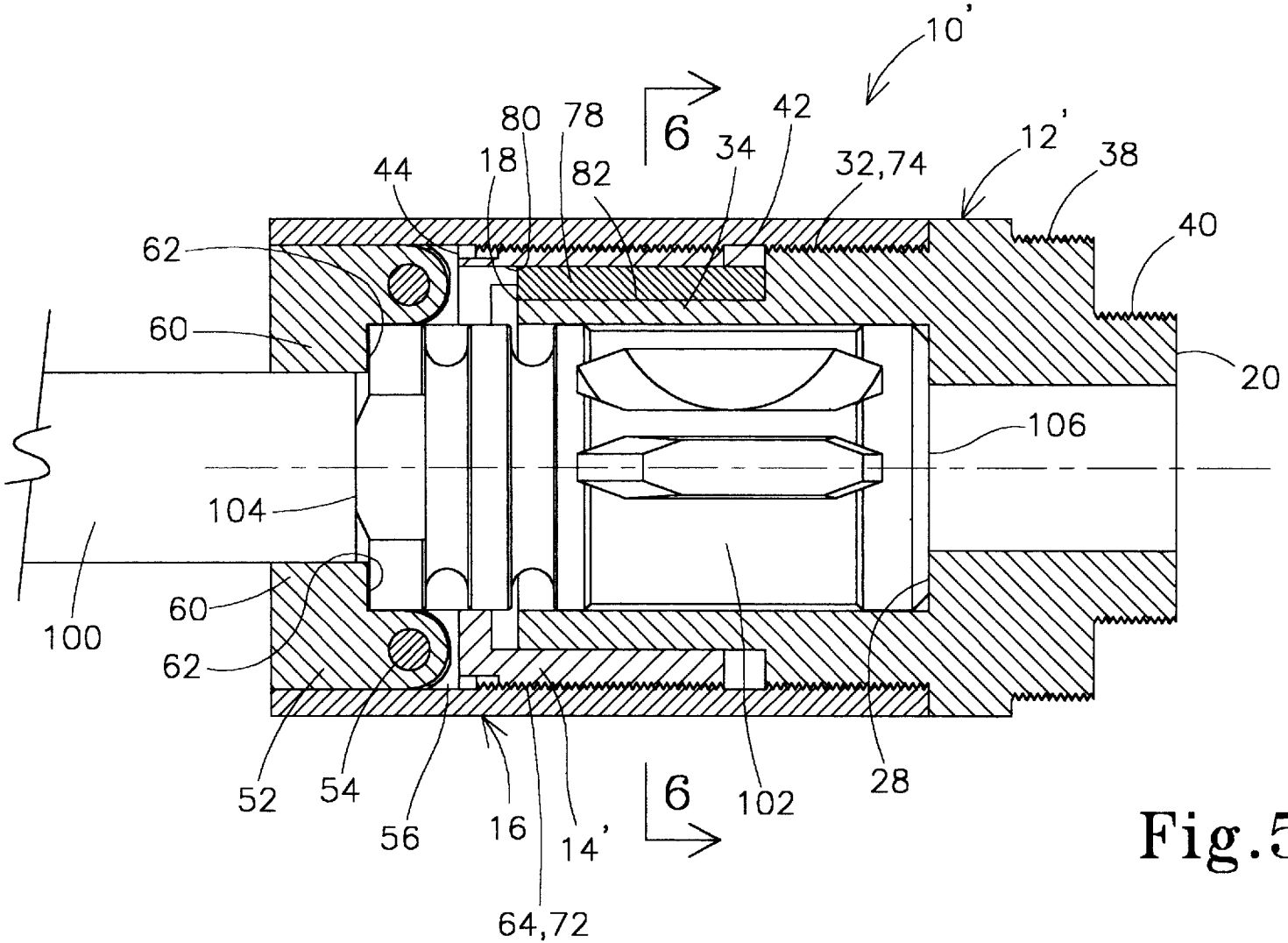
FIG. 5 illustrates an elevation view, in section, an alternate embodiment of the device of the present invention taken at 5—5 of FIG. 4.
Figure 7:
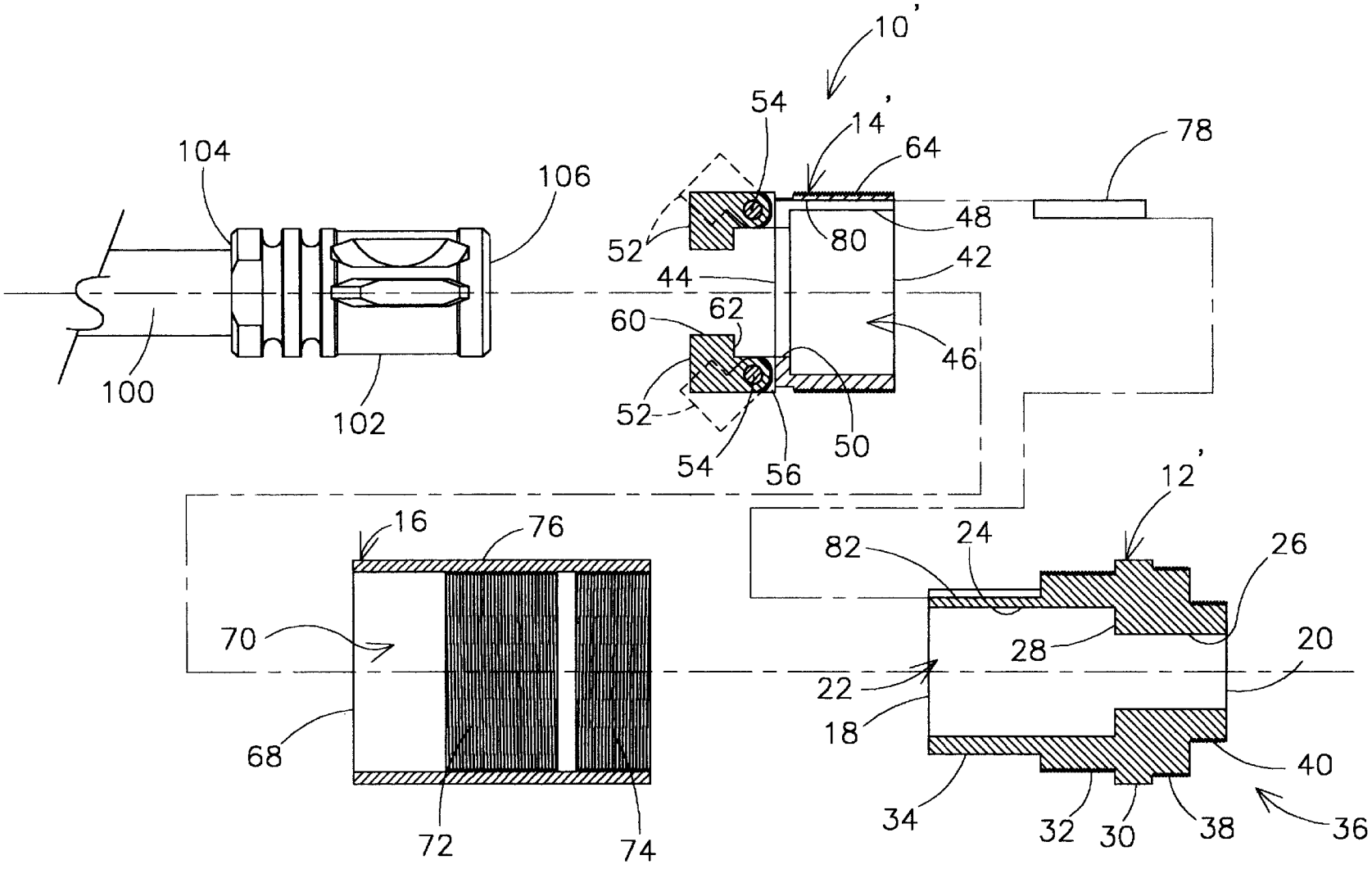
FIG. 7 is an exploded view of the elevation view illustrated in FIG. 5.

FIGS. 5–7 illustrate an alternate embodiment of the present invention. Those components which are identical as described above are labeled with similar numerals. However, those elements which are varied from the description above are labeled with a similar numeral followed by a "'" symbol. In the alternate embodiment of the coupler 10', a key 78 is received within a key receptor 82 defined by the main body 12' between the first end 18' and the first threaded portion 32' thereof. A key receptor 80 is also defined within the through bore 46' defined by the inner collar 14'. The key receptors 80,82 are configured to closely receive the key 78 such that rotation of the inner collar 14' with respect to the main body 12' is prevented, thereby insuring that as the outer collar 16 is rotated, neither of the inner collar 14' and main body 12' is rotated, thereby insuring that the two will either move toward or away from one another. In this embodiment, the main body 12' is engaged with the outer collar 16 as above. The inner collar 14' is the inserted into the outer collar 16 such that the key 78 is received within each of the key receptors 80,82. The coupler 10' is then mounted as described above, with the outer collar 16 being rotated until the coupler 10' is firmly received upon the firearm. The sound suppressor 108 is then mounted as described above.

From the foregoing description, it will be recognized by those skilled in the art that a coupler for attaching a suppressor to a firearm flash hider offering advantages over the prior art has been provided. Specifically, the coupler is provided for mounting a sound suppressor to the flash hider of a firearm such that mounting of the coupler on the firearm and use of the firearm while the coupler is mounted thereon does not cause harm to the barrel of the firearm. Furthermore, the coupler of the present invention is designed to be quickly mounted to and dismounted from the flash hider of a firearm, and to be used such that the safety of the firearm is not compromised.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A coupler for attaching a suppressor to a firearm flash hider, said coupler comprising:

a main body defining first and second ends, said first end being configured to engage a distal end of the firearm flash hider;

a sound suppressor attachment device carried by said main body between a central ring and said main body second end;

an inner collar defining first and second ends, said second end being configured to engage a proximal end of the firearm flash hider; and an outer collar defining a substantially cylindrical member having a through bore with an inner diameter configured to closely receive and engage said main body first end and said inner collar, said outer collar being rotated to selectively move said main body and said inner collar toward and away from one another in order to respectively mount and dismount said coupler on the firearm flash hider.

2. The coupler of claim 1 wherein said main body further defines a through bore extending between said first and second ends, said through bore being configured at said first end to define a first inner diameter dimensioned to closely receive the firearm flash hider, said through bore being configured at said second end to define a second inner diameter dimensioned to be at least as large as the firearm barrel bore, said main body defining a shoulder within said through bore to limit axial movement of said main body with respect to the firearm flash hider, said main body defining an outer surface having a central ring defining a first outer diameter, a first threaded portion proximate said central ring and toward said first end, said first threaded portion defining a second outer diameter smaller than said first outer diameter defined by said central ring, said first threaded portion having threads configured as right-handed threads as defined by standard convention, said main body defining a cylindrical configuration between said first end and said first threaded portion and defining a third outer diameter smaller than the second outer diameter.

3. The coupler of claim 2 wherein said inner collar further defines a through bore oriented coaxially thereto, said through bore defining a first inner diameter proximate said first end dimensioned to receive said main body first end, said through bore defining a second inner diameter proximate said second end and dimensioned to be substantially equal to said main body first inner diameter, said inner collar defining a threaded portion including threads having a left-handed orientation, said threaded portion defining an outer diameter equal to said second outer diameter defined by said main body first threaded portion.

4. The coupler of claim 3 wherein said outer collar defines an outer diameter substantially equal to said first outer diameter defined by said main body central ring, said outer collar defining a first threaded portion on an interior wall and configured to cooperate with said main body first threaded portion and a second threaded portion configured to cooperate with said inner collar threaded portion.

5. The coupler of claim 4 wherein said outer collar defines a gripping surface to facilitate rotation thereof.

6. The coupler of claim 5 wherein said gripping surface is knurled.

7. The coupler of claim 3 wherein said main body defines a key receptor extending between said main body first end and said main body first threaded portion, and wherein said inner collar defines a key receptor with said through bore and proximate said inner collar first end, said coupler further comprising a key configured to be closely received within said main body key receptor and said inner collar key receptor such that rotation of said inner collar with respect to said main body is prevented.

8. The coupler of claim 1 further comprising a locking mechanism carried by said inner collar and including a plurality of fingers, each said finger being pivotally mounted on said inner collar via a pivot pin received within a bracket defined by said inner collar on either side of said finger, said inner collar further defining a recess on a side of each bracket opposite said finger, said plurality of fingers being radially spaced around said inner collar second end, each finger defining an extended portion having an engagement surface for engaging the proximal end of the firearm flash hider.

9. The coupler of claim 1 wherein said sound suppressor attachment device comprises second and third threaded portions defined by said main body proximate said second end thereof, said main body second and third threaded portions being adapted to cooperate with threaded portions defined by the sound suppressor.

10. A coupler for attaching a suppressor to a firearm flash hider, said coupler comprising:

a main body defining first and second ends and a through bore extending between said first and second ends, said through bore being configured at said first end to define a first inner diameter dimensioned to closely receive the firearm flash hider, said through bore being configured at said second end to define a second inner diameter dimensioned to be at least as large as the firearm barrel bore, said main body defining a shoulder within said through bore to limit axial movement of said main body with respect to the firearm flash hider, said main body defining an outer surface having a central ring defining a first outer diameter, a first threaded portion proximate said central ring and toward said first end, said first threaded portion defining a second outer diameter smaller than said first outer diameter defined by said central ring, said first threaded portion having threads configured as right-handed threads as defined by standard convention, said main body defining a cylindrical configuration between said first end and said first threaded portion and defining a third outer diameter smaller than the second outer diameter;

a sound suppressor attachment device carried by said main body between said central ring and said main body second end;

an inner collar defining first and second ends and a through bore oriented coaxially thereto, said through bore defining a first inner diameter proximate said first end dimensioned to receive said main body first end, said through bore defining a second inner diameter proximate said second end and dimensioned to be substantially equal to said main body first inner diameter, said inner collar defining a threaded portion including threads having a left-handed orientation, said threaded portion defining an outer diameter equal to said second outer diameter defined by said main body first threaded portion;

a locking mechanism carried by said inner collar and including a plurality of fingers, each said finger being pivotally mounted on said inner collar via a pivot pin received within a bracket defined by said inner collar on either side of said finger, said inner collar further defining a recess on a side of each bracket opposite said finger, said plurality of fingers being radially spaced around said inner collar second end, each finger defining an extended portion having an engagement surface for engaging the proximal end of the firearm flash hider; and an outer collar defining a substantially cylindrical member having a through bore with an inner diameter configured to closely receive said main body first end and said inner collar, said outer collar defining an outer diameter substantially equal to said first outer diameter defined by said main body central ring, said outer collar defining a first threaded portion on an interior wall and configured to cooperate with said main body first threaded portion and a second threaded portion configured to cooperate with said inner collar threaded portion, said main body and said inner collar thus being moved away from one another when said outer collar is rotated in a first direction, and said main body and said inner collar being moved toward one another when said outer collar is rotated in a second direction, said outer collar defining a gripping surface to facilitate rotation thereof.

11. The coupler of claim 10 wherein said sound suppressor attachment device comprises second and third threaded portions defined by said main body proximate said second end thereof, said main body second and third threaded portions being adapted to cooperate with threaded portions defined by the sound suppressor.

12. The coupler of claim 10 wherein said main body defines a key receptor extending between said main body first end and said main body first threaded portion, and wherein said inner collar defines a key receptor with said through bore and proximate said inner collar first end, said coupler further comprising a key configured to be closely received within said main body key receptor and said inner collar key receptor such that rotation of said inner collar with respect to said main body is prevented.

* * * * *